US005695408A

United States Patent [19]

DeLaCruz et al.

[11] Patent Number: 5,695,408

[45] Date of Patent: Dec. 9, 1997

[54] GOLF CLUB SHAFT

[75] Inventors: Richard DeLaCruz, Carlsbad; Richard Parente, San Diego; Richard Tennent, Alpine, all of Calif.

[73] Assignee: Goldwin Golf USA, Inc., Carlsbad, Calif.

[21] Appl. No.: 590,547

[22] Filed: Jan. 24, 1996

[51] Int. Cl.[6] ..... A63B 53/12; A63B 53/14

[52] U.S. Cl. ..... 473/300; 473/316

[58] Field of Search ..... 473/316, 300, 473/301, 302, 303, 203, 204, 321, 323

[56] References Cited

U.S. PATENT DOCUMENTS

| | | | |
|---|---|---|---|
| Re. 19,731 | 10/1935 | Hackett . | |
| 1,012,299 | 12/1911 | True . | |
| 1,974,389 | 9/1934 | Cowdery . | |
| 3,606,326 | 9/1971 | Sparks . | |
| 3,614,101 | 10/1971 | Hunter . | |
| 4,132,579 | 1/1979 | Vanauken . | |
| 4,597,578 | 7/1986 | Lancaster | 473/300 |
| 5,419,031 | 5/1995 | McLendon . | |
| 5,460,372 | 10/1995 | Cook | 473/204 |
| 5,547,189 | 8/1996 | Billings | 473/305 |
| 5,569,048 | 10/1996 | Klein | 473/305 |
| 5,569,097 | 10/1996 | Veux | 473/316 |

FOREIGN PATENT DOCUMENTS

| | | |
|---|---|---|
| 2682607 | 4/1993 | France . |
| 28465 | 12/1908 | United Kingdom . |
| 2202319 | 9/1988 | United Kingdom . |

*Primary Examiner*—Sebastiano Passaniti

*Attorney, Agent, or Firm*—Cooley Goodward LLP; Craig P. Opperman

[57] ABSTRACT

Article of manufacture comprising a golf club shaft is described as having a grip region which approximates the diameter of a standard golf club with a compliant grip. Applied to the shaft is an ultra thin grip with a view to reducing the overall weight of the shaft and thereby shifting the balance point of a golf club incorporating the shaft to a region just proximate the head.

23 Claims, 4 Drawing Sheets

GOLF CLUB SHAFT

FIELD OF THE INVENTION

The present invention relates to golf clubs and, more particularly, the invention relates to shafts and grips forming a part of such clubs.

BACKGROUND OF THE INVENTION

In its simplest terms, a golf club consists of an elongate shaft carrying, at the lower end, a head having a striking surface and, at the upper end, a grip. The terminal portion of the upper end of the shaft is termed the butt end and the terminal portion of the lower end is termed the tip end.

Conventional golf clubs generally have tapered shafts made of steel, metal alloys, or composite materials. Such shafts have traditionally had a tapered shape whose cross section changes continuously and smoothly, and whose maximum diameter is measured at the butt end and minimum diameter is measured at the tip end.

More recently, golf club shafts have been created which depart from the straight taper convention and provide parallel regions, constricted regions and expanded regions located in diverse areas in the shaft. The stated purpose for such variations are to control the mechanical properties of the club, i.e., the elastic line under torsion and/or flexion of the shaft, while providing desirable ergonometric qualities in the grip area of the club.

Traditionally, conventional clubs have a slip-on grip of compliant material, in order to provide a conventional grip dimension so that the club will fit a broad range of users.

DISCLOSURE OF THE INVENTION

The present invention provides for improved golf club shafts and golf club incorporating such shafts of extremely light weight and thereby providing golf clubs with a balance point located in the region where the club head is joined to the shaft.

In one aspect, the present invention provides a golf club shaft having a butt end and a tip end, the tip end for receiving a golf club head, the shaft comprising a grip region extending from the butt end of the shift to a first point on the shaft and defining a portion of the shaft that is covered by a grip, the grip portion having a diameter substantially equal to a standard golf club with a compliant grip. The remainder of the shaft from the grip portion to the tip portion will be of an ever decreasing diameter.

DETAILED DESCRIPTION OF THE INVENTION

The present invention provides golf club shafts which, when combined with preferred grips, present an ultralight shaft combination for mounting a golf club head. Golf clubs constructed in accordance with the present invention will have improved playing characteristics by virtue of the decreased weight of the shaft and the resultant balance point located proximate the region where the head joins the shaft.

Figure 1:
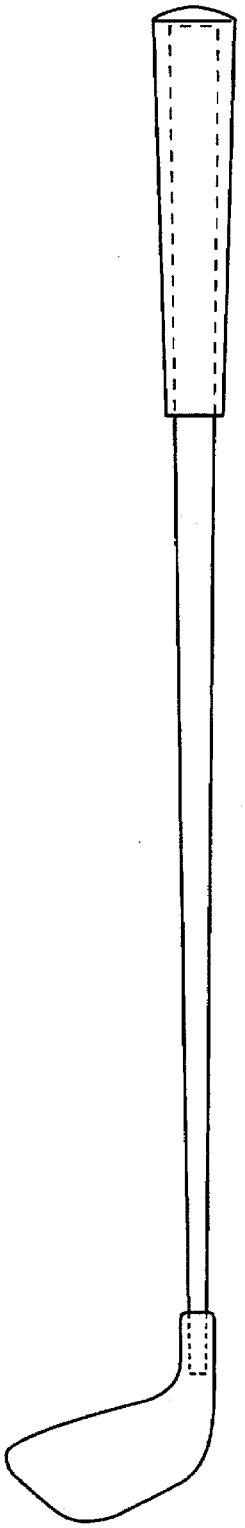
FIG. 1 (PRIOR ART)
FIG. 1 is a schematic view of a golf club according to the prior art.
Figure 1A:
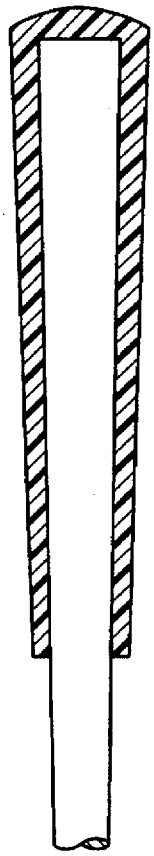
FIG. 1A (PRIOR ART)
FIG. 1A is a detailed view of a cross section of the grip region of the club of FIG. 1.

In the prior art, as depicted in FIG. 1, a golf club conventionally consists of an elongate shaft carrying, at the lower end, a head having a striking surface and, at the upper end, a grip. The terminal portion of the upper end of the shaft is termed the butt end and the terminal portion of the lower end is termed the tip end. The shaft will generally have a straight taper, often terminating in a parallel region at the tip end for insertion into the head.

Figure 2:
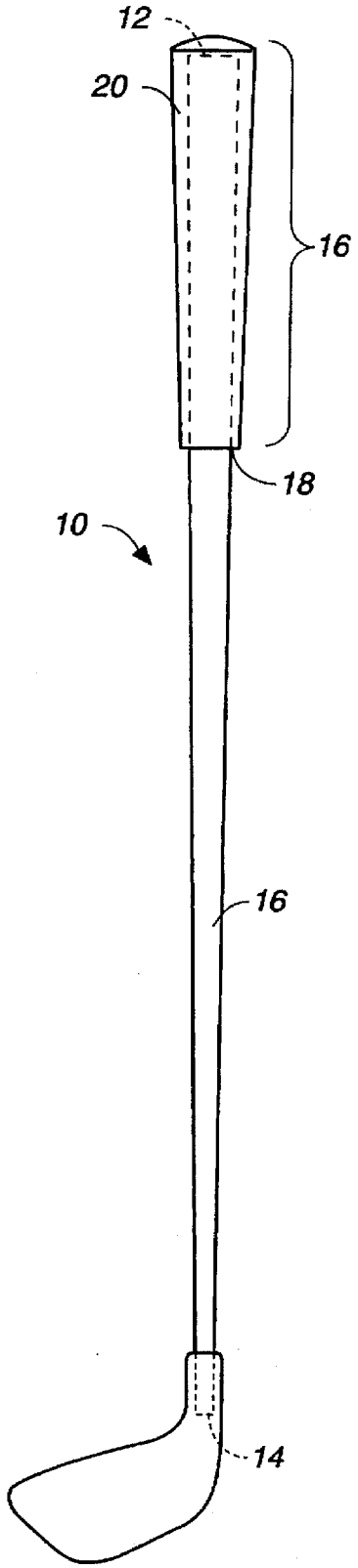
FIG. 2 is a view of a golf club according to the present invention.
Figure 2A:
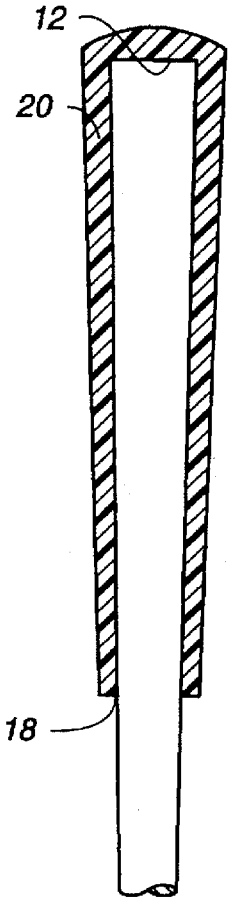
FIG. 2A is a detailed view of a cross section of the grip region of the club of FIG. 2.

The shaft of the present invention, as initially illustrated in FIG. 2 and in greater detail in FIG. 2*a*, can comprise a straight taper shaft 10 having a butt end 12 and a tip end 14, the shaft comprising a grip region 16, extending from the butt end of the shaft to a first point 18 on the shaft and defining a portion of the shaft that is substantially covered by a grip 20, each portion of the grip region 16 having a diameter substantially equal to the diameter in the corresponding location in a standard golf club with a compliant grip.

According to the prior art, and as depicted in FIG. 1, compliant grips are most usually slip-on grips of rubber or other compliant materials, generally weighing between 35 and 55 grams. The grips will often have substantially greater wall thickness at the butt end, decreasing to a thinner wall only at the lower end of the grip. Attempts have been made to decrease the thickness of the wall of such slip-on grips, but such attempts usually produce grips which are difficult to install or tear during the process of installation. Shafts constructed in accordance with the prior art and equipped with a grip most typically include a straight taper region to facilitate installing the grip on the shaft. Therefore, any substantial variation in overall grip diameter in order to accommodate a comfortable positioning of the users hands on the grip will be a feature of the grip diameter, established by the thickness of the grip wall at that position. Thus the maximum diameter of the grip section is limited by the maximum outer diameter of the grip. The grip must have a diameter large enough to enable a player to comfortably hold and swing the club in the normal manner. Most players hands are of similar sizes, and the standard outer diameters of golf club grips are well known in the art.

In the present invention, the grip will comprise a thin compliant wrap of substantially uniform thickness, typically on the order of approximately 1 to approximately 2 millimeters. Such grips will typically weigh in the range of approximately 7 to approximately 10 grams. Grips ordinarily utilized for tennis rackets will prove to be of use in this regard.

Figure 3:
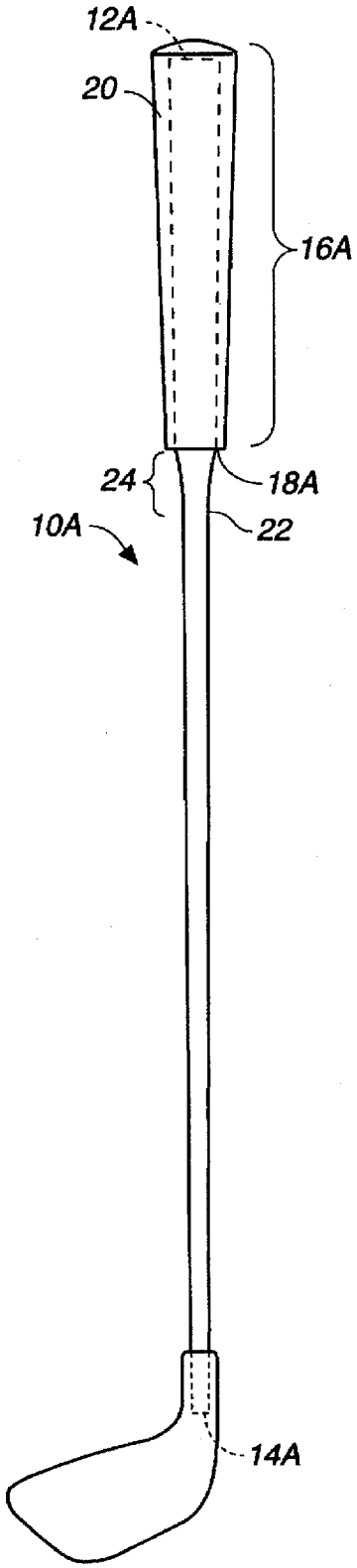
FIG. 3 is a view of an alternative embodiment of a golf club according to the present invention
Figure 3A:
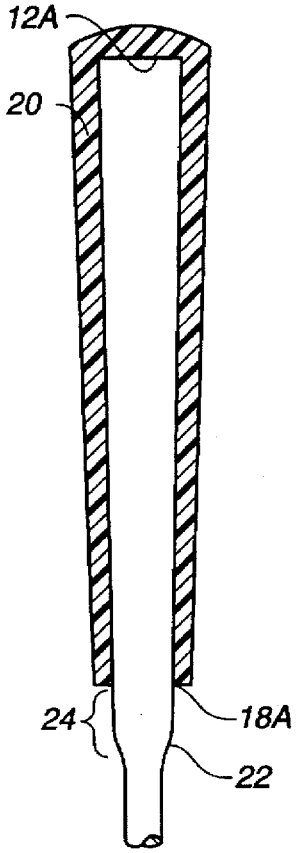
FIG. 3A is a detailed view of a cross section of the grip region of the club of FIG. 3.

Although a straight taper shaft as described above will provide certain of the benefits of the present invention, additional benefits by way of reduced weight can be obtained by further reductions in shaft diameter below the grip region. As depicted in FIG. 3, shaft 10A having a butt end 12A and a tip end 14A, can be provided with a grip region 16A, comparable to the shaft of FIG. 2. In addition, the portion between first point 18A on the shaft and a second point 22 will define a second portion of the shaft 24 having a radical taper so as to reduce the diameter of the shaft 10A in a short run length. From point 22 extending to tip 14A, defining a third portion provides a straight taper to the tip region.

Figure 4:
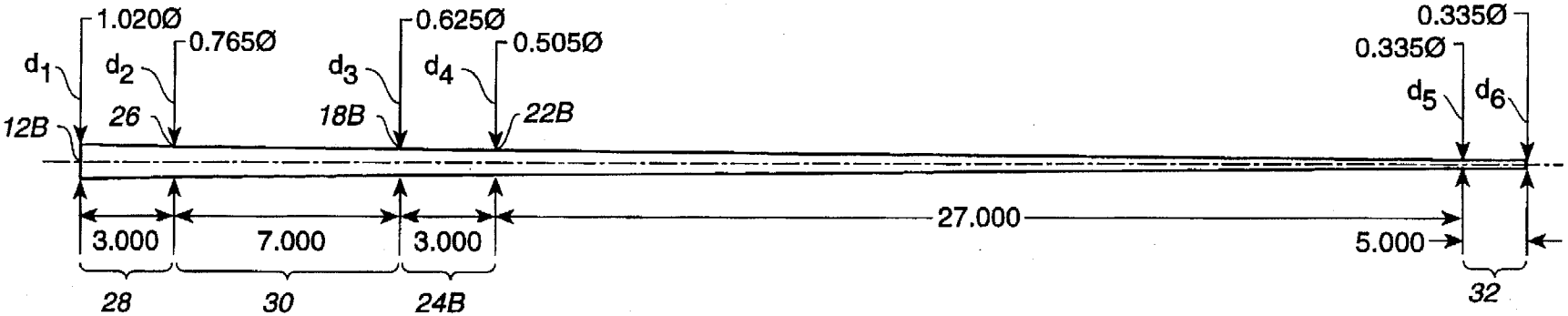
FIG. 4 (PRIOR ART)
FIG. 4 is a schematic diagram of an alternative embodiment of a shaft in accordance with the present invention, depicting the shaft diameters at selected points along the length of an exemplary shaft.

Further improvements can also be provided, as depicted in FIG. 4, by providing a shaft 10B wherein the grip portion 16B further comprises a butt region 28, defined as the taper established from butt end 12B to intermediate point 26, having a first non-zero taper approximating the butt end of a conventional grip, and a grip region 30 defined as the taper established from intermediate point 26 to the end of the grip portion at point 18B, and having a second non-zero taper approximating the mid region of a conventional grip. In such an embodiment, the shaft will thereby establish a diameter substantially equal to the diameter in the corresponding location in a standard golf club with a compliant grip.

In the embodiment of FIG. 4, depicted as having a conventional shaft length of approximately 45 inches and sized to approximately correspond to a club shaft designed for the male user, the diameters of the boundary of each taper region are shown as: $d_1$ (1.020 inches), $d_2$ (0.765 inches), $d_3$ (0.625 inches), $d_4$ (0.505 inches), $d_5$ (0.335 inches) and $d_6$ (0.335 inches), $d_5$ and $d_6$comprising the boundaries of the parallel region conventionally inserted into the head of the club.

Shafts constructed in accordance with the invention can be made of materials commonly used for shaft construction. For example, shafts can be made out of lightweight steel in accordance with means well known in the art, that is, in a generally cylindrical configuration with a central aperture extending axially throughout the entire length thereof. The shaft is typically light weight, ranging from approximately 3.75 to 4.00 ounces. The shaft wall in the butt section will have a thickness of about 0.016 inches and a thickness of about 0.020 inches adjacent to the tip section for greater rigidity. The wall thickness can be reduced somewhat in the regions between the butt and tip section, typically to approximately 0.014 inches in order to achieve certain weight reductions.

Alternatively, and desirably, the manufacture of the present shafts will be accomplished with conventional fiber composite materials and manufacturing methods, but with certain accommodations to the new shaft designs as described in further detail below.

Materials from which composite shafts of the present invention are made will be any of the well known reinforcing fibers and resin materials for the composites. Preferred fibers for reinforcement are the carbon, glass, aramid and extended chain polyethylene fibers, most preferably the carbon fibers. As used herein, the term carbon fibers encompasses all carbon-based fibers, including graphite fibers. Reinforcement fibers are available commercially from a variety of sources and under numerous different trade names including for example Kevlar™ for aramid fibers and Spectra™ for extended chain polyethylene fibers. These fibers, and there use as resin reinforcements are widely described in the literature; one comprehensive source is *Handbook of Plastic Materials and Technology*, Ruben ed., Chapter 70–77, Wiley Interscience (1990). Other sources of information include, for carbon fibers, *Fiber-reinforced Composites: Material, Manufacture and Design*, Marcel Decker, New York (1988); Gill, *Carbon Fibers in Composite Materials*, Iliffe Books, London (*1972*); and Watt, et al. *Handbook of Composites, Vol. 1: Strong* Fibers, Elsevier Science Publishers, New York (1985), and for other fibers, including glass and aramid, *Modern Plastics Encyclopedia*, 88, 64, 10*a*, 183–190 (1987). Typical of the resins which may be used are thermosetting resins or polymers such as the phenolics, polyesters, melamines, epoxies, polyimides, polyurethanes and silicones; the properties and methods of manufacture of these polymers are also described in the previously mentioned *Handbook of Plastic Materials and Technology* and *Modern Plastics Encyclopedia*.

In the manufacture of composite shafts of the invention, the shaft is first laid-up around a conventional steel mandrel having at each section a diameter equal to what will eventually be the inner diameter of the shaft itself. The mandrel will have a taper in order to facilitate withdrawal of the mandrel from the shaft after forming. The different plies of the fiber reinforced composite are laid up in sequence with the resin matrix in a flexible beta stage. The composite plies will be laid up with any desired combination of axial orientation (longitudinal to the shaft), radial orientation (circumferential to the shaft) and bias orientation (fiber orientations at an angle between the radial and axial orientations) between adjacent layers. Commonly the bias fiber orientation is on the order of 30 to 90 degrees to the axis of the shaft. Commonly any particular cross-section of fiber reinforced composite material will have at least two different fiber orientations to provide structural integrity. The outer-most layers are usually laid up with axial orientation.

To produce certain shafts in accordance with the invention, such as shafts having a severe taper joining one tapered region to another, the production process must differ substantially from the lay up processes used for production of straight taper shafts or shafts having a mild radius of curvature in the sections where regions of distinct tapers join. Such simple processes involve only a single lay up step similar to that described above. In the present invention, however, certain embodiments will have a radical taper establishing the conjunction between two tapered regions in order to minimize shaft diameter and provide further decrease in weight. In providing abrupt transitions between tapered regions, the angle established on the mandrel will often display a tendency to permit the fiber wrap to migrate along the mandrel toward the smaller diameter region, giving rise to wrinkles or thin spots in the wrapped shaft. In order to combat this tendency, once the fiber reinforced composite layers are laid up to the desired thickness of each section and portion of each section, the entire shaft is wrapped with a layer of dry fiberglass to stabilize the underlying layers. It appears that this dry fiberglass layer serves to wick the resin outward from the wrapped shaft rather than allowing it to migrate longitudinally along the shaft and facilitate the repositioning of the fiber wrap to the smaller diameter region.

Thereafter, the entire shaft is baked in a curing oven to cure the beta stage polymer in the composite and form a hard matrix of solid polymer in which the reinforcing fibers are securely fixed. During cure, the polymer will normally flow to fill any interstices in the matrix and to form a relatively smooth outer surface for the shaft. The exact curing temperature and cure time for the oven cure will be functions of the particular polymer (or polymer mixture) being used in the composite. Curing temperatures and times are widely known and published for the polymers useful in this invention. As is well known, there is an inverse relationship between time and temperature; higher temperatures require shorter cure times and vice versa. One skilled in the art can readily determine the optimum time and temperature values for the particular polymer being used and the shaft dimensions, to produce full or limited cure of the polymer.

Once the polymer cure is completed, the shaft is removed from the curing oven and allowed to cool. Thereafter it is usually machined (normally by sanding or grinding) to smooth a shaft surface and to remove the fiberglass outer wrap from substantially the entire shaft. Following the machining, the shaft is finished by buffing and polishing of the surface to remove any remaining surface imperfections and to produce a high gloss, attractive club shaft.

If desired, one can thereafter add additional wraps or coatings to the shafts outer surface to impart colors, design patterns or the like to the shaft in any one or more of the sections, and produce attractive colored, logoed or patterned club shafts. It is also possible to add a textured coating material to one or more of the areas of the surface of the shaft, although it is generally preferred to retain a smooth untextured surface.

Typically the shaft is finished by having applied a clear coat finish such as a clear polyurethane, for maximum durability and resistance to weather and sun.

Shafts are normally subjected to typical quality control tests to confirm the flex, torque and stiffness characteristics, as well as to measure any other properties which the manufacturer or vendor believes to be significant. In this regard, it will be typical to establish the balance point of the club head and shaft combination in the completed club in order to determine the fulfillment of the desired objectives. Finally, it is common to coat the shafts with a peelable protective coating such as a clear plastic film, to protect the shafts during shipment to the club manufacturers.

The shafts of the present invention have highly desirable properties because of the substantial reduction in weight while maintaining the strength of more traditional prior art shafts. The present shafts allow for the construction of clubs which substantially increase the kinetic energy applied to the ball as the lightweight shaft and head combination can be swung at a higher velocity for any given user. As is well known physical phenomena, the kinetic energy imparted to the ball may be increased more rapidly by an increase in the velocity of the striking object than in the mass of the object itself. In addition, by reducing the weight in the shaft, the user will be more clearly able to establish the position of the club head during the swing without the distraction of the rather substantial sensory input created by swinging a relatively heavy shaft.

All patent publications cited in this specification are herein incorporated by reference as if each individual publication or patent application were specifically and individually indicated to be incorporated by reference.

Although the foregoing invention has been described in some detail by way of illustration and example for purposes of clarity and understanding, it will be apparent to those of ordinary skill in the art in light of the teaching of this invention that certain changes and modifications may be made thereto without departing from the spirit or scope of the appended claims.

We claim:

1. A golf club shaft and grip material combination in which the shaft comprises:

(a) a butt end having an outer diameter of at least 1 inch;

(b) a tip end having an outer diameter of less than 0.45 inches;

(c) a non-zero tapered shaft portion extending at least part of the distance between the tip end and the butt end; and (d) a non-zero-degree tapered grip section between the tapered shaft portion and the butt end; and in which the grip material is disposed about the grip section to define a first, non-zero-degree grip taper proximate to the butt end and a second, non-zero-degree grip taper shallower than the first grip taper.

2. The combination as recited in claim 1, wherein the tapered grip section has a taper steeper than the taper of the tapered shaft portion.

3. The combination as recited in claim 2, further comprising a composite material.

4. The combination as recited in claim 3, wherein the shaft has a weight of 3.75 to 4.00 ounces.

5. The combination as recited in claim 4, wherein the shaft has a wall thickness of less than 0.02 inches at the butt end.

6. The combination as recited in claim 1, wherein the shaft butt end with the grip material disposed about the grip section has an outer diameter of at least 1.1 inches.

7. A golf club shaft, comprising:

(a) a butt end having an outer diameter of at least 1 inch;

(b) a tip end;

(c) a grip region including a first non-zero-degree taper proximate to the butt end, and a second non-zero-degree taper, proximate to and shallower than the first taper; and a third taper, proximate to and distinct from the second taper (d) an intermediate shaft portion between the tip and the grip region, defining an intermediate, non-zero-degree taper distinct from the second taper.

8. The golf club shaft as recited in claim 7, further comprising a composite material.

9. The golf club shaft as recited in claim 7, further comprising a grip material defining a grip at the grip region.

10. The golf club shaft as recited in claim 9, wherein the grip material has a substantially uniform thickness.

11. The golf club shaft as recited in claim 9, wherein the grip has an outer diameter of at least 1.1 inches at the butt end.

12. The golf club shaft as recited in claim 11, wherein the shaft has a non-uniform wall thickness.

13. The golf club shaft as recited in claim 10, wherein the second taper tapers from an outer diameter of at least 0.7 inches at its point closest to the butt end, to an outer diameter of at least 0.6 inches at its point furthest from the butt end.

14. The golf club shaft as recited in claim 10, wherein the shaft has a wall thickness at the butt end is less than 0.02 inches.

15. The shaft of claim 10, wherein the grip region further includes a third, non-zero-degree taper between the second taper and the intermediate shaft portion, wherein the third taper is shallower than the second taper.

16. The shaft of claim 15, wherein the third taper is steeper than the intermediate taper.

17. A golf club, comprising:

a composite shaft including a butt end of at least 1 inch outer diameter, a tip end, and an intermediate portion between the butt end and the tip end defining at least one non-zero degree taper;

(b) a golf club head mounted at the tip of the shaft; and (c) a grip region between the shaft tip end and intermediate portion and including first and second non-zero-degree tapers, the first taper being disposed adjacent the butt end and being steeper than the second taper.

18. The golf club as recited in claim 17, wherein the shaft has a weight of 3.75 to 4.00 ounces.

19. The golf club as recited in claim 17, wherein the shaft has an outer diameter of at least 1 inch at the butt end, and the second grip taper tapers from an outer diameter of at least 0.7 inches at its end closest to the butt end, to an outer diameter of at least 0.6 inches at its point closest to the tip end.

20. The club of claim 19, wherein the intermediate portion tapers from an outer diameter of at least 0.5 inches at a point closest to the grip region to an outer diameter of at least 0.3 inches at a point closest to the tip end.

21. The club of claim 17, further comprising a grip material disposed about the grip region.

22. The club of claim 21, wherein the grip material is substantially uniformly thick.

23. The club of claim 22, wherein the butt end with a grip material disposed about it has an outer diameter of at least 1.1 inches.

* * * * *